United States Patent [19]

Dola

[11] 4,406,931

[45] Sep. 27, 1983

[54] JOYSTICK SWITCH

[75] Inventor: Frank P. Dola, Port Richey, Fla.

[73] Assignee: AMP Incorporated, Harrisburg, Pa.

[21] Appl. No.: 391,311

[22] Filed: Jun. 23, 1982

[51] Int. Cl.[3] ..... H01H 25/00

[52] U.S. Cl. ..... 200/6 A; 200/67 DB; 200/276

[58] Field of Search ..... 200/6 A, 61.44, 61.41, 200/61.42, 61.24, 153 K, 276, 277, 67 DA, 67 DB

[56] References Cited

U.S. PATENT DOCUMENTS

| | | | |
|---|---|---|---|
| 1,639,952 | 8/1927 | Mayoza | 200/6 A |
| 3,033,946 | 5/1962 | Meyer et al. | 200/6 A |
| 3,092,698 | 6/1963 | Brenneman | 200/67 DB |
| 3,193,628 | 7/1965 | Wanlass | 200/6 A |
| 3,238,316 | 3/1966 | Voss | 200/6 A |
| 3,488,461 | 1/1970 | Webb | 200/61.42 |
| 3,809,839 | 5/1974 | Beddoe | 200/276 X |
| 4,045,650 | 8/1977 | Nestor | 200/264 X |

*Primary Examiner*—J. R. Scott
*Attorney, Agent, or Firm*—F. Brice Faller

[57] ABSTRACT

Joystick switch comprises a handle attached to a support member carrying a ball member which rides in a socket fixed on a base. A straight length of resilient wire fixed to the base passes through an aperture defined by four discrete contacts in the base and into a bore in the ball member where it is slideably received. Arcuate movement of the handle causes lateral deflection of the wire into contact with the contacts to generate signals for x-y directional control. Die cast zinc circuitry in the base provides grounding for the wire and signal current for the contacts. Resilient return action for the handle is effected by an elastomeric ring in the base which bears on an annular surface of the support member.

7 Claims, 9 Drawing Figures

JOYSTICK SWITCH

BACKGROUND OF THE INVENTION

The present invention relates to a joystick switch, a device for generating signals for x-y directional control responsive to pivotal movement of an elongate handle.

Joystick switches are currently enjoying popularity as x-y directional control switches in electronic games found both in commercial environments and in the home in conjunction with television sets. Joystick switches of the prior art generally employ ball and socket type joints and individual switches which are actuated by one end of the joystick in response to movement of the handle end of the stick by the operator's hand. Cam tracks are often employed to direct the end of the joystick to the desired switch and metal springs are often employed to effect return of the handle. Known joystick assembly schemes are often complex in structure and time-consuming and expensive to manufacture.

SUMMARY OF THE INVENTION

The present invention is directed to a joystick switch which is inexpensive to manufacture, employs a minimum of parts, and is simple to assemble. The joystick employs a hemispherical support member with an elongate handle and a ball member which pivots in a socket carried by a base; a resilient wire is fixed relative to the base and passes through a passage therein into a bore in the ball member. The wire passes through an aperture defined by four signal contacts in the base; pivoting the handle causes the wire, which is grounded, to contact one of the signal contacts to provide an electrical signal for x-y directional control. Contacts and circuitry on the base are cast zinc. Return action is provided by a ring-shaped elastomeric member sandwiched between the support member and the base. The simplicity of design makes the subject joystick switch quite durable and resistant to breakage.

BRIEF DESCRIPTION OF THE DRAWINGS

FIG. 3A is an enlarged view of the ground contact.

DETAILED DESCRIPTION OF THE PREFERRED EMBODIMENT

Figure 1:
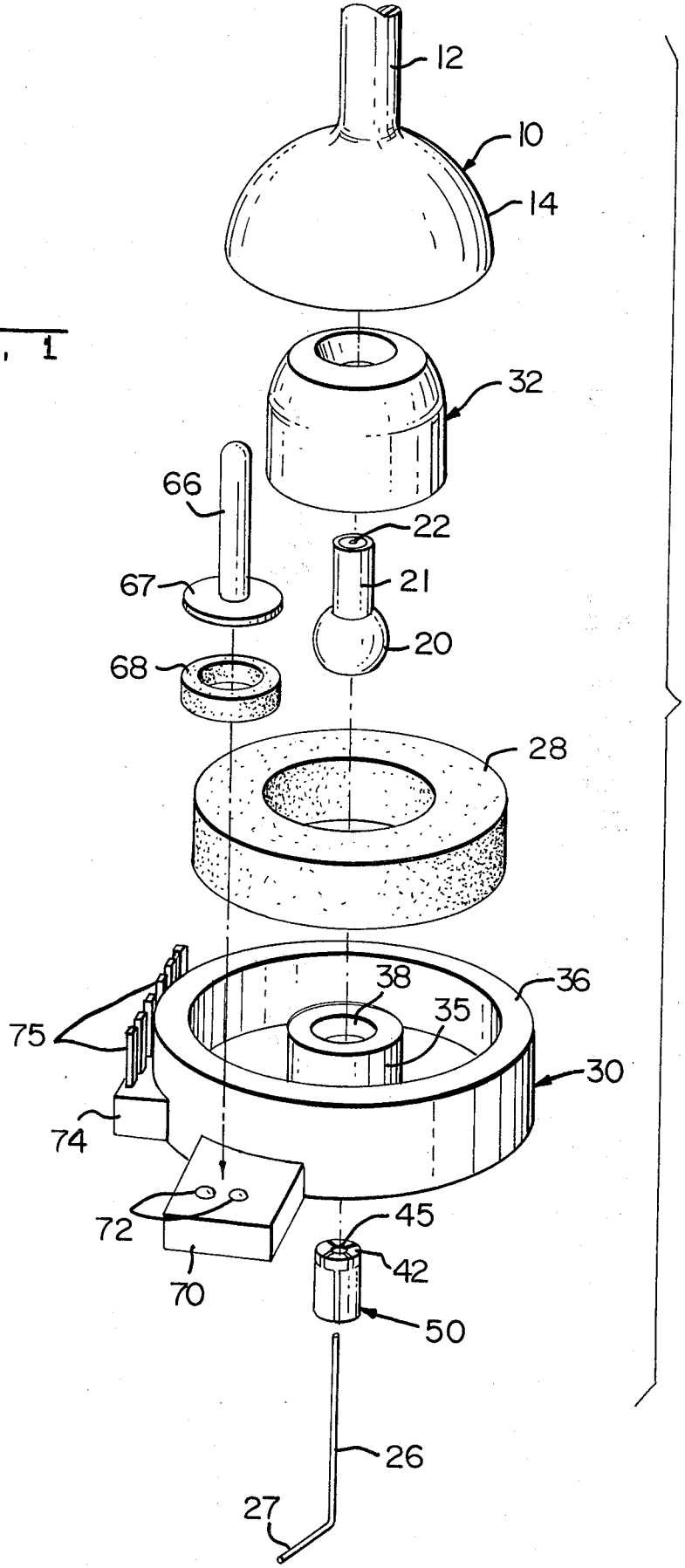
FIG. 1 is an exploded perspective of the joystick switch.
Figure 7A:
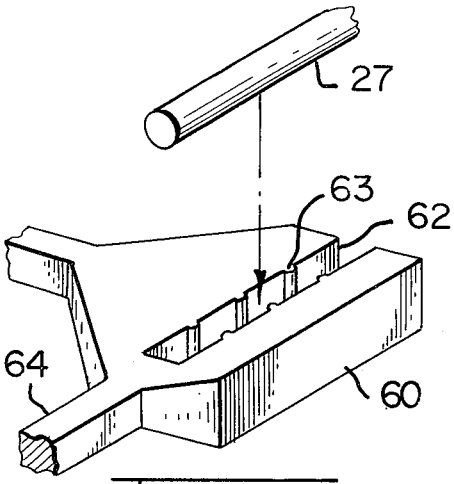
FIG. 7 is a schematic perspective of the switch in the dynamic position.

FIG. 1 depicts the components of the joystick switch, which include a support member 10, a socket housing 32, a ball member 20, an elastomeric ring 28, a base member 30, a contact retention plug 50, and a wire spring 26. When assembled, the wire spring 26 passes through aperture 45 between contacts 42 in the contact support plug 50 and into bore 22 through the ball member 20. The ball member 20 is captured between the housing 32 and lower socket surface 38 on the base 30, while top portion 21 is fixed in the support member 10. Movement of handle 12 causes transmission of electrical current to one of the pins 75 in pin pedestal 74 through circuit traces on the bottom of base 30 as will be explained. The joystick switch includes as an optional or auxiliary feature a firing button 66 on metal disc 67 which, when depressed, compresses elastomeric ring 68 and bridges contacts 72 on firing button pedestal 70.

Figure 2:
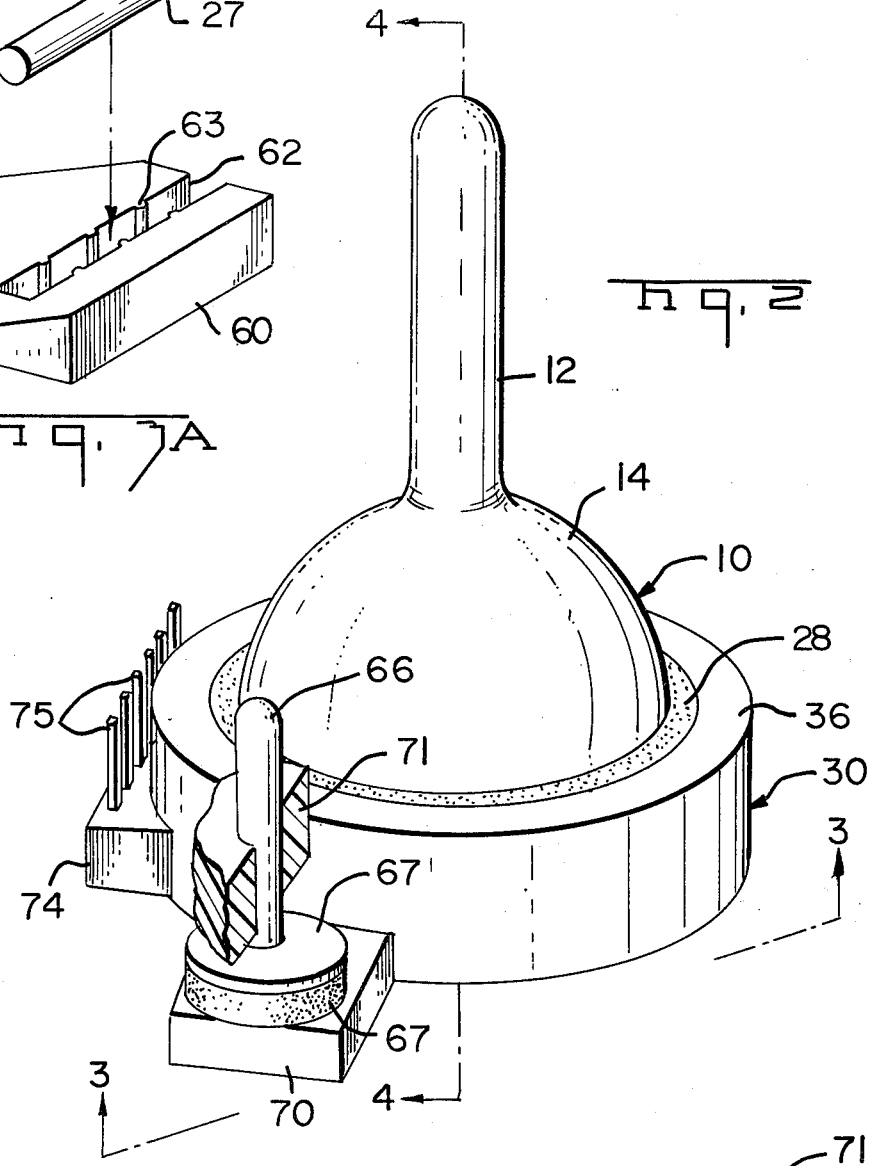
FIG. 2 is a perspective of the assembled joystick switch.

FIG. 2 depicts the assembled joystick switch sans housing 71, only a portion 71 of which is shown where firing button 68 passes therethrough. Support member 10 rests on elastomeric ring 28 which maintains the switch in the open or static position when handle 12 is not subjected to arcuate movement.

Figure 3:
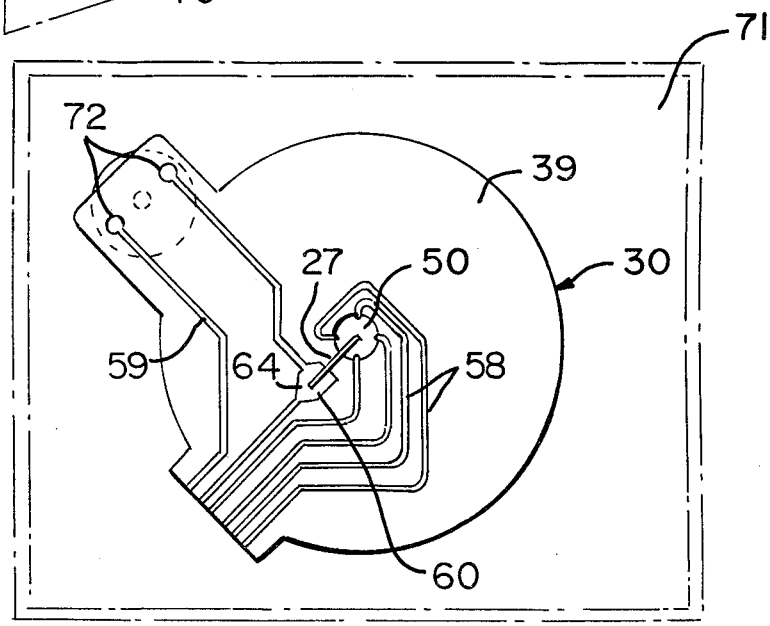
FIG. 3 is a plan view of the bottom of the switch showing circuitry thereon as seen from line 3—3 of FIG. 2.

The bottom surface 39 of the base member 30 is depicted in FIG. 3. Signal circuit traces 58 are connected to signal contacts 42 (FIG. 6) in the contact support plug 50. A leg 27 of wire spring 26 (FIG. 1) is fit in the bottom of plug 50 and into ground contact piece 60 on ground trace 64, which is connected to one of the firing button contacts 72. The other contact 72 is connected to firing button signal trace 59. The traces 58, 59, 64, piece 60, and firing button contacts 72 are die cast into recesses in the surface 39 of the base 30. The preferred metal is zinc, and the base 30 is preferably nylon. FIG. 3A details the ground contact piece 60 which receives leg 27 of the wire spring 26 in channel 62. Ribs 63 on the sides of channel 62 deform to ensure an interference fit of leg 27, which is a flexible hard metal such as beryllium copper or phosphorous bronze.

Figure 4:
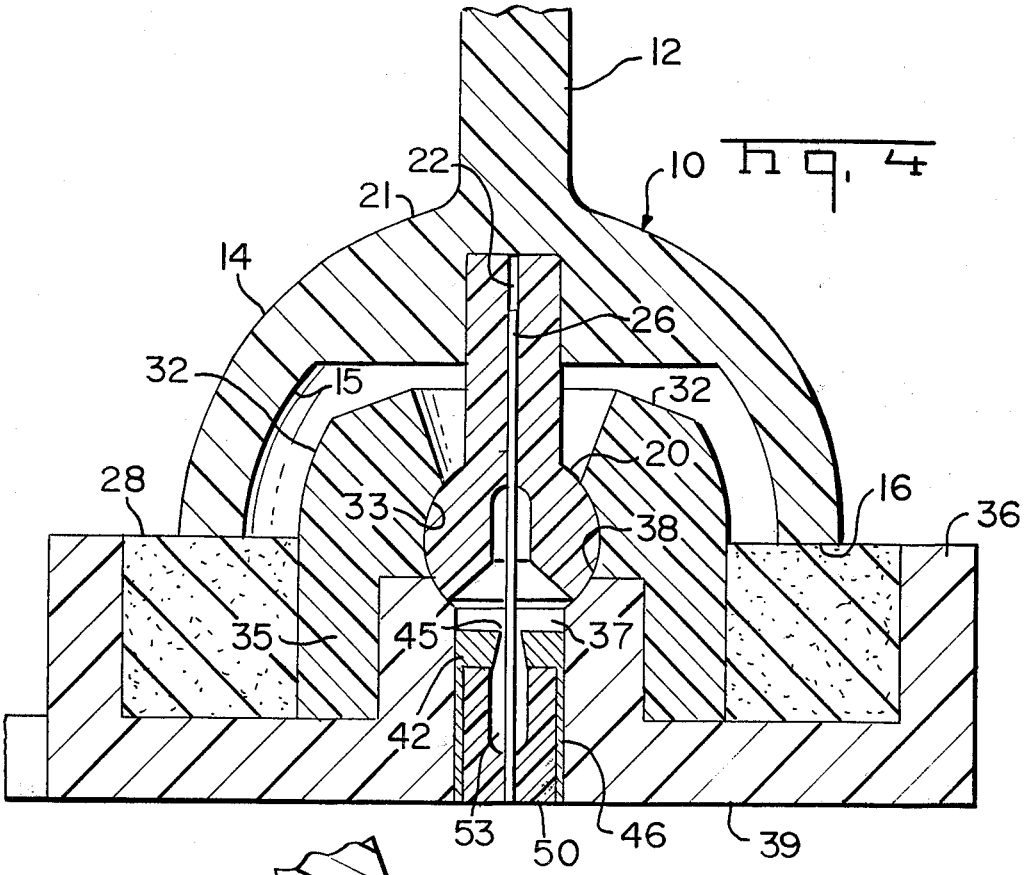
FIG. 4 is a cross section of the switch in the static position taken along line 4—4 of FIG. 2.
Figure 6:
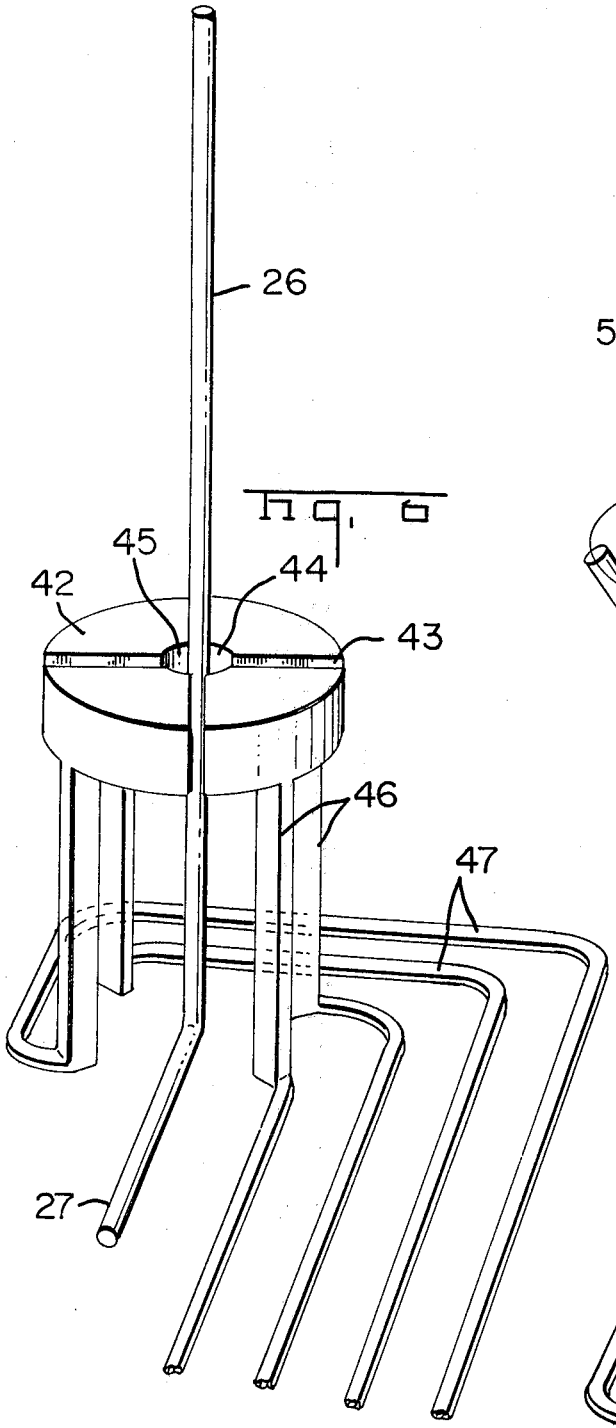
FIG. 6 is a schematic perspective of the switch in the static position.

FIG. 4 is a cross section of the assembled joystick switch in the static or open position; this view provides best vantage for explaining the assembly steps. The four signal contacts 42 in plug receiving passage 37 are cast in a continuum with respective legs 46 which in turn are continuous with traces 47 (FIG. 6). The wire spring 26 is fit through passage 53 in contact support plug 50 and the plug 50 is fit over the contacts 42 and legs 46 to maintain their position in plug receiving passage 37. The ball member 20 is then seated on lower socket surface 38 on base member 30, while wire spring 26 is received slideably in spring bore 22 through the cylindrical top portion 21 of the ball member 20. The socket housing 32 is then fit over cylindrical section 35 of the base 30; latches may be provided for a snap-fit, or these pieces may be glued together. The ball member 20 is thus captured between upper socket surface 33 and lower socket surface 38. Elastomeric ring 28 is then fit between the socket housing 32 and the outer wall 36 of base 30, and the support member 10 is fit onto top portion 21 of the ball member. This is likewise retained by a snap-fit or glue. The top portion has an outer or convex surface 14 and an inner or concave surface 15 which faces the socket housing 32. An annular surface 16 forms the boundary between surfaces 14, 15 and is in contact with the elastomeric ring 28, which maintains the handle 12 in upright position so that spring 26 passes clearly through the aperture 45 defined by contacts 42.

Figure 5:
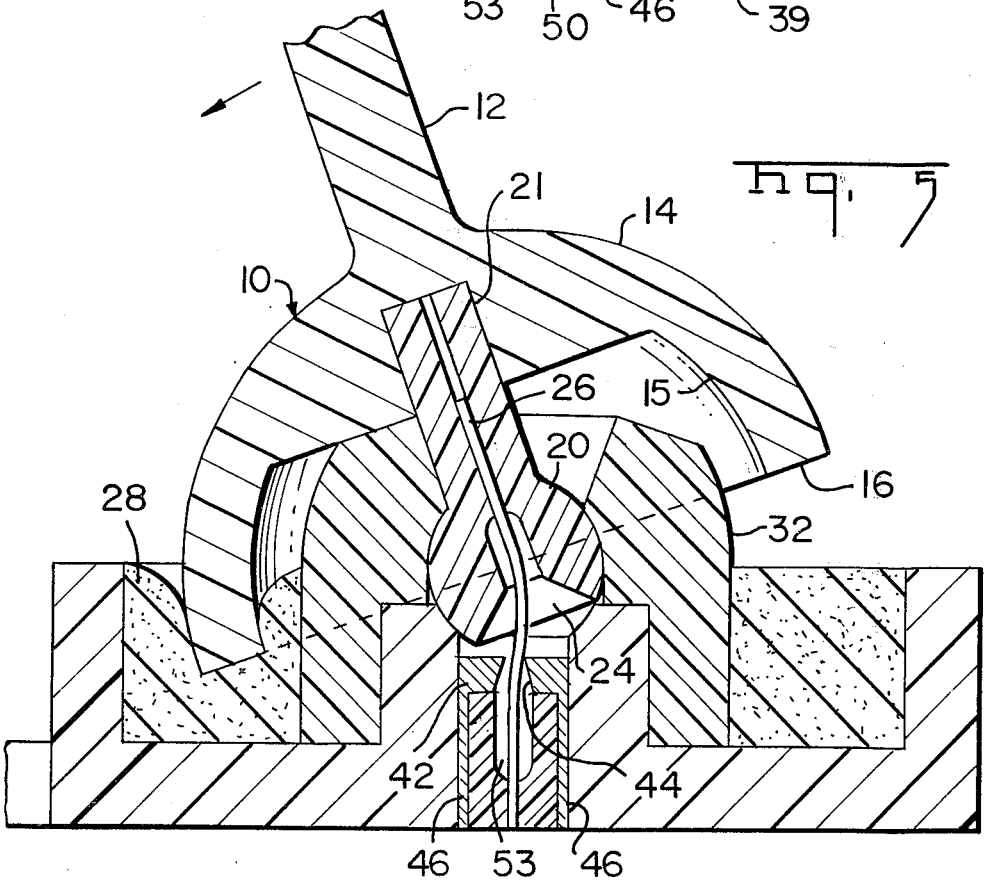
FIG. 5 is a cross section of the switch in the dynamic position.

FIG. 5 shows the switch in the dynamic or closed position as the handle 12 is subjected to arcuate movement, subjecting the ring 28 to elastomeric compression where the surface 16 bears against it. Funnel opening 24 in the ball member 20 permits lateral movement of the wire spring 26 without subjecting it to stress sufficient to permanently deform it. The spring 26 is thus deflected until it touches one of the contacts 42, which occurs as handle 12 is deflected about 5°. Additional deflection of the handle 12 to about 15° as shown in FIG. 5 is possible; this merely results in additional bowing of spring 26 in funnel opening 24 as the spring 26 slides further down bore 22 in the top portion 21 of the ball member 20. Travel is ultimately limited by the support member 10 abutting the top of the socket housing 32, as shown. Note that the wire 21 touches a contact 42 only at the top edge of inner surface 44. Eventually, as the zinc wears, the contact point will recede downward and the wire will touch surface 44 in a more parallel fashion.

FIG. 6 is a perspective of the electrical components of the joystick switch isolated from the other components. The contacts 42 are connected to respective signal circuit traces 47 by legs 46. The contacts 42 are situated radially about an aperture 45 defined by the inwardly facing surfaces 44 of the contacts. The switch is in the open or static position as the wire 26 passes clearly through the aperture 45.

Figure 7:
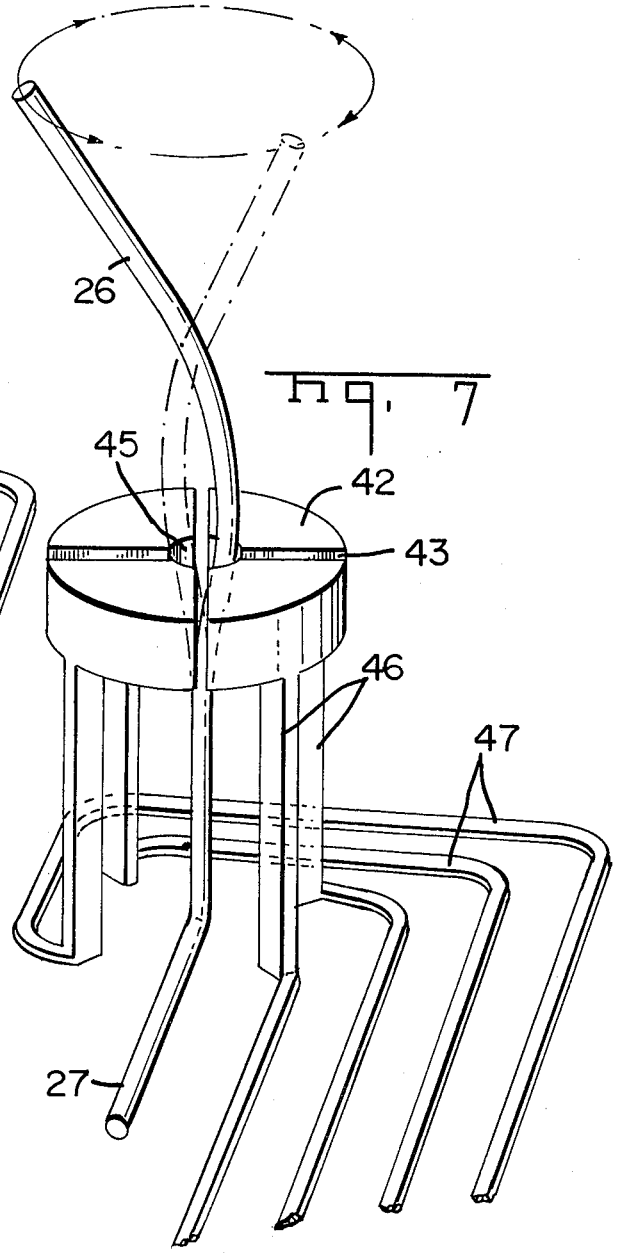

FIG. 7 shows the switch in the dynamic state as the wire 26 is deflected to close the switch by completing an electrical circuit between the grounded leg 27 of the spring wire 26 and one of the contacts 42. Arcuate movement of the handle 12 thus generates x-y directional control signals. Note that gaps 43 between the contacts 42 are narrow enough to permit bridging of two contacts 42 so that eight different signal combinations are possible. Where only four signals are desired, as for movement strictly in x-y directions, the gaps would be wider and filled with extensions of the support plug 50, which is a dielectric.

Figure 8:
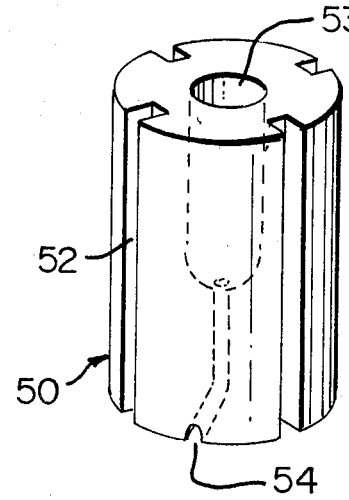
FIG. 8 is a perspective of the contact support plug.

FIG. 8 details the contact support plug 50 which is fit into the plug receiving passage 37 of the base (FIG. 4). Channels 52 receive the legs 46 which connect the contacts 42 to respective circuit traces 47 and the bottom channel 54 receives the leg 27 of wire 26 while the remainder of the wire 26 fits through wire receiving passage 53, the bottom portion of which is a close fit while the upper portion of the channel 53 is contiguous with aperture 45 (FIG. 6) and permits lateral deflection of wire 26.

Other embodiments within the scope of the invention include a ball-control type switch, which is similar to the preferred embodiment without a handle. Such a switch is actuated by gripping the convex surface with the fingertips and effecting arcuate movement.

I claim:

1. A joystick switch comprising:

a support member with an integral elongate handle, said support member carrying a ball member coaxially with said elongate handle, said ball member having a bore therein which is coaxial with the axis of said elongate handle, said bore slideably receiving a length of resilient wire which is straight when in an undeformed state, said wire extending beyond said ball member, a base member having socket means thereon, said base member having an aperture extending therethrough from said socket means, said socket means receiving said ball member therein, said wire extending into said aperture, said base member having four discrete contacts fixed therein and situated radially about said aperture, the center of said aperture being coaxial with said handle when said wire is in an undeformed state, said straight length of wire passing clearly through said aperture when said wire is in an undeformed state, said wire being fixed relative to a surface of said base opposite said aperture from said socket means, first resilient means between said support member and said base member, said first resilient means urging said support member toward a position where said wire is straight, whereby, arcuate movement of said handle will cause said ball member to rotate in said socket means and said wire to deflect toward said contacts.

2. A joystick switch as in claim 1 wherein said wire is electrically continuous with a ground circuit trace carried on said surface of said base where said wire is fixed thereto, and each of said contacts is electrically continuous with a respective signal circuit trace carried by said base, whereby arcuate movement of said handle will complete a circuit between a signal circuit trace and said ground circuit trace as said handle is moved arcuately and said wire contacts at least one of said contacts about said aperture.

3. A joystick switch as in claim 2 wherein said circuit traces are cast metal, said signal circuit traces being cast continuously with said signal contacts.

4. A joystick switch as in claim 3 wherein said metal is zinc.

5. A joystick switch as in claim 1 wherein said four discrete contacts are situated in a plug receiving passage through said base member from said surface to said socket means, said passage receiving a support plug closely therein, said plug being profiled to receive said contacts therein thereby positioning said contacts, said plug having a wire receiving passage therethrough, said wire passing through said aperture into said passage and being fixed relative to said plug.

6. The joystick switch of claim 1 wherein said discrete contacts have gaps therebetween which are smaller than the diameter of said wire, whereby said wire can bridge two signal contacts without being deflected therebetween.

7. The joystick switch of claim 1 wherein said resilient means comprises a ring-shaped elastomeric member carried on said base concentrically with said socket means, and said support member comprises a hemispherical member having a convex side and a concave side, said handle extending from said convex side and said ball member extending from said concave side, said hemispherical member having an annular surface between said concave and convex sides, said elastomeric member bearing against said annular surface resiliently when said handle is moved arcuately.

* * * * *